US007269874B2

(12) United States Patent
Hung

(10) Patent No.: US 7,269,874 B2
(45) Date of Patent: Sep. 18, 2007

(54) CLEANING DEVICE FOR CLEANING DUCTS AND PIPES

(76) Inventor: Yoen Hung, 17529 128th Ave. SE., Renton, WA (US) 98058

( * ) Notice: Subject to any disclaimer, the term of this patent is extended or adjusted under 35 U.S.C. 154(b) by 86 days.

(21) Appl. No.: 11/367,878

(22) Filed: Mar. 5, 2006

(65) Prior Publication Data

US 2006/0195994 A1 Sep. 7, 2006

Related U.S. Application Data

(63) Continuation-in-part of application No. 11/202,837, filed on Aug. 12, 2005.

(60) Provisional application No. 60/658,760, filed on Mar. 4, 2005.

(51) Int. Cl.
*B08B 9/04* (2006.01)

(52) U.S. Cl. ..... 15/104.095; 15/104.33

(58) Field of Classification Search ..... 15/104.05, 15/104.09, 104.095, 104.16, 104.2, 104.31, 15/104.33

See application file for complete search history.

(56) References Cited

U.S. PATENT DOCUMENTS

| | | | | | |
|---|---|---|---|---|---|
| 566,110 | A | * | 8/1896 | Wrigley | 15/104.33 |
| 1,107,250 | A | * | 8/1914 | Bigham | 254/134.3 FT |
| 2,042,407 | A | | 5/1936 | Kugelman | |
| 2,074,213 | A | | 3/1937 | Deem | |
| 2,102,917 | A | | 12/1937 | Rolland | |
| 2,284,939 | A | * | 6/1942 | Asnard | 15/104.33 |
| 2,450,486 | A | * | 10/1948 | Perry | 15/104.33 |
| 2,482,345 | A | * | 9/1949 | Kincaid | 15/104.33 |
| 2,504,391 | A | * | 4/1950 | Carson | 15/104.33 |
| 2,625,699 | A | * | 1/1953 | Jurasevich | 15/104.33 |
| 2,629,121 | A | | 2/1953 | Petre | |
| 2,819,481 | A | | 1/1958 | Lockert | |
| 2,961,675 | A | | 11/1960 | Stickney | |
| 3,268,937 | A | * | 8/1966 | Bollinger | 15/104.33 |
| 3,994,310 | A | | 11/1976 | Brandon | |
| 4,218,802 | A | | 8/1980 | Babb et al. | |
| 4,617,693 | A | * | 10/1986 | Meyer et al. | 15/104.33 |
| 4,792,363 | A | | 12/1988 | Franklin, Jr. et al. | |
| 4,793,017 | A | * | 12/1988 | Kaye | 15/104.33 |

(Continued)

FOREIGN PATENT DOCUMENTS

EP 0650774 A1 5/1995

(Continued)

*Primary Examiner*—Mark Spisich
(74) *Attorney, Agent, or Firm*—Christopher Wood; Wood & Eisenberg, PLLC

(57) ABSTRACT

A cleaning device 100 for cleaning a generally elongated duct or pipe, including: a housing 120 having a front end 124 and a rear end 126; an inner-drum 300 having a front end 340, a rear end 360, a sidewall 380, and a sidewall inner-surface 400, the inner-drum 300 is located inside the housing 120; a drive shaft 320 protruding from the rear end 360 and through the rear end 126; a drive member 140 that is attachable to the drive shaft 320; a cable 180 abutting against the inner-surface 400 of the inner-drum 300, wherein the cable 180 has opposite proximal 200 and distal 220 ends, wherein during normal operation the distal end 220 protrudes through the front end 340 and through the front end 124; and a cleaning member 240, wherein the cleaning member 240 is attachable to the distal end 220.

18 Claims, 6 Drawing Sheets

U.S. PATENT DOCUMENTS

| | | | | | |
|---|---|---|---|---|---|
| 4,800,616 | A | | 1/1989 | Wade | |
| 5,109,567 | A | | 5/1992 | Harrison | |
| 5,230,116 | A | | 7/1993 | Rodriguez | |
| 5,265,301 | A | * | 11/1993 | Irwin | 15/104.33 |
| 5,369,834 | A | | 12/1994 | Groen et al. | |
| 5,383,243 | A | | 1/1995 | Thacker et al. | |
| 5,402,548 | A | | 4/1995 | Adair et al. | |
| 5,500,974 | A | * | 3/1996 | Wu | 15/104.33 |
| 5,584,093 | A | | 12/1996 | Melendres | |
| 5,608,941 | A | | 3/1997 | Kleinfeld | |
| 5,655,256 | A | | 8/1997 | Hendrix et al. | |
| 5,735,016 | A | | 4/1998 | Allen et al. | |
| 5,802,667 | A | | 9/1998 | Williams | |
| 5,862,568 | A | | 1/1999 | Sjoberg | |
| 6,026,538 | A | | 2/2000 | Watanabe | |
| 6,372,052 | B1 | | 4/2002 | Jones | |
| 6,553,601 | B1 | | 4/2003 | Major | |
| 2005/0028307 | A1 | | 2/2005 | Wu | |
| 2005/0109375 | A1 | | 5/2005 | Peterson | |

FOREIGN PATENT DOCUMENTS

| | | |
|---|---|---|
| JP | 10128260 | 5/1998 |
| JP | 2003329234 | 11/2003 |

* cited by examiner 100
140
140h
126y
126a
126
126c
162
560
360c
320
360
200
560
420
400
380
560
300b
440
300a
220
180
540
540
340a
340c
340
240
540
280
280
260
260
124
124c
124a
124y
128

CLEANING DEVICE FOR CLEANING DUCTS AND PIPES

CROSS-REFERENCE TO RELATED APPLICATIONS

This application is a continuation-in-part (CIP) patent application and claims the benefit of priority from U.S. patent application Ser. No. 11/202,837, filed Aug. 12, 2005. The present application also claims the benefit of priority from U.S. Provisional Patent Application Ser. No. 60/658,760, filed Mar. 4, 2005. The entire contents of U.S. patent application Ser. Nos. 60/658,760 and 11/202,837 are incorporated by reference herein in their entirety.

FIELD OF THE INVENTION

This invention relates to a cleaning device for cleaning ducts and duct-like structures such as pipes.

BACKGROUND OF THE INVENTION

While they might be hidden from eyesight for much of their working lives, ducts and duct-like structures pay an integral role in everyday life. A home is often kitted out with what is often referred to as "central air", wherein artificially cooled or warmed air is directed via dedicated ductwork to various rooms around the house. Over time ductwork becomes lined with dust and grime from everyday use. Absent cleaning, dirty ducts can lead to health issues for homeowners and renters, and might present hidden dangers for children and adults with, for example, lung disorders. Individuals with weakened immune systems or immune disorders, including asthmatic children and adults, can face unexpected health dangers absent regular cleaning of ductwork.

A review of the prior art follows.

U.S. Patent Publication No. 20050028307, published Feb. 10, 2005 to Wu, describes a snake that includes a handle, a flexible cable, multiple brushes with various sizes and a crank. The handle has a proximal end, a distal end and a ring with an eye on the distal end. The flexible cable is described as being made of glass fiber with a rear end attached to the proximal end of the handle, a front end and a connector attached to the front end of the flexible cable. A brush shaft has a rear end attached to the connector, a front end and a head attached to the front end of the brush shaft. The brushes each have a shank that can detachably attach to the head of the brush shaft. The crank is L-shaped and has a longitudinal arm, a transverse arm with a free end to be inserted through the ring and a cap with an aperture attached to the transverse arm of the crank.

U.S. Patent Publication No. 20050109375, published May 26, 2005 to Peterson, describes a vent cleaning apparatus for removing dust from air conditioning and heating vents and wherein unnecessary torque loads on the flexible shaft are eliminated by the presence of swivel cuff means between the exhaust opening where the flexible tubular conduit containing the shaft is connected to the apparatus and the flexible tubular conduit itself.

U.S. Pat. No. 6,553,601, issued Apr. 29, 2003 to Major, describes a pipe end cleaner device formed in a set of sizes to be mounted in the chuck of an electric drill for cleaning the ends of pipes in preparation for connections by threading or soldering. The cleaner device has a plurality of internal grooves configured and dimensioned to secure a conventional bristle brush having external grooves on its ring.

Japanese Patent No. JP10128260, published May 5, 1998 to Kirigatani Yoichi, describes an apparatus for cleaning an inner wall of a pipe by fitting a brush in the pipe, slightly holding down a brush shaft with one side hand, grasping a handle with the other hand and rotating a crank shaft.

Japanese Patent No. JP2003-329234, published Nov. 19, 2003 to Fukuma Yoshito, describes a duct cleaning apparatus. The apparatus comprises a lateral duct, a main shaft reciprocating in an axial direction of the lateral duct. Rotation about the axis is provided. A link chain is spirally wound around the outer peripheral wall of the main shaft, and one end portion and the other end portion of the link chain are fixed on the outer peripheral surface of the main shaft.

SUMMARY OF THE INVENTION

A cleaning device 100 for cleaning a generally elongated duct or pipe, comprising: a housing 120 of generally cylindrical appearance having a front end 124 and a rear end 126; an inner-drum 300 having a front end 340, a rear end 360, a sidewall 380, and a sidewall inner-surface 400, wherein the inner-drum 300 is located inside the housing 120; a drive shaft 320 protruding from the rear end 360 of the inner-drum 300 and through the rear end 126 of the housing 120; a drive member 140 that is attachable to the drive shaft 320; a cable 180 abutting against the inner-surface 400 of the inner-drum 300, wherein the cable 180 has opposite proximal 200 and distal 220 ends, wherein during normal operation the distal end 220 protrudes through the front end 340 of the inner-drum 300 and through the front end 124 of the housing 120; and a cleaning member 240, wherein the cleaning member 240 is attachable to the distal end 220 of the cable 180, wherein rotation of the drive shaft 320 causes rotation of the inner-drum 300, and wherein rotation of the inner-drum 300 causes the distal end 220 of the cable 180 to rotate thereby rotating the cleaning member 240 when fitted to the distal end 220 of the cable 180.

It should be understood that the attached figures are not intended to limit the scope of the present invention in any way.

DETAILED DESCRIPTION OF THE INVENTION

This invention relates to a cleaning device for cleaning ducts and duct-like structures such as pipes. The cleaning device of the invention is denoted generally by the numeric label "100".

Figure 1:
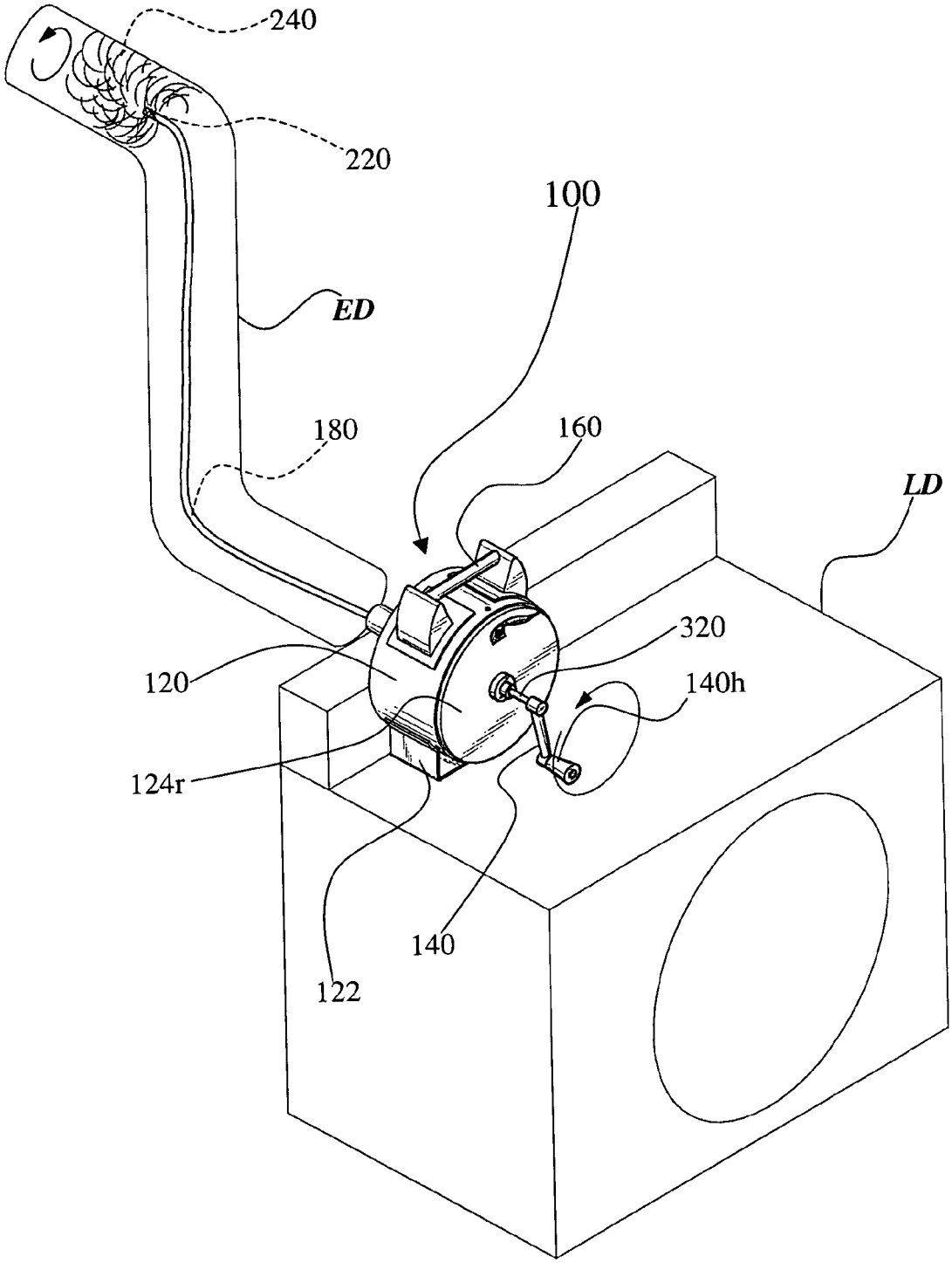
FIG. 1 is an environmental perspective view of the cleaning device of the present invention.
Figure 2:
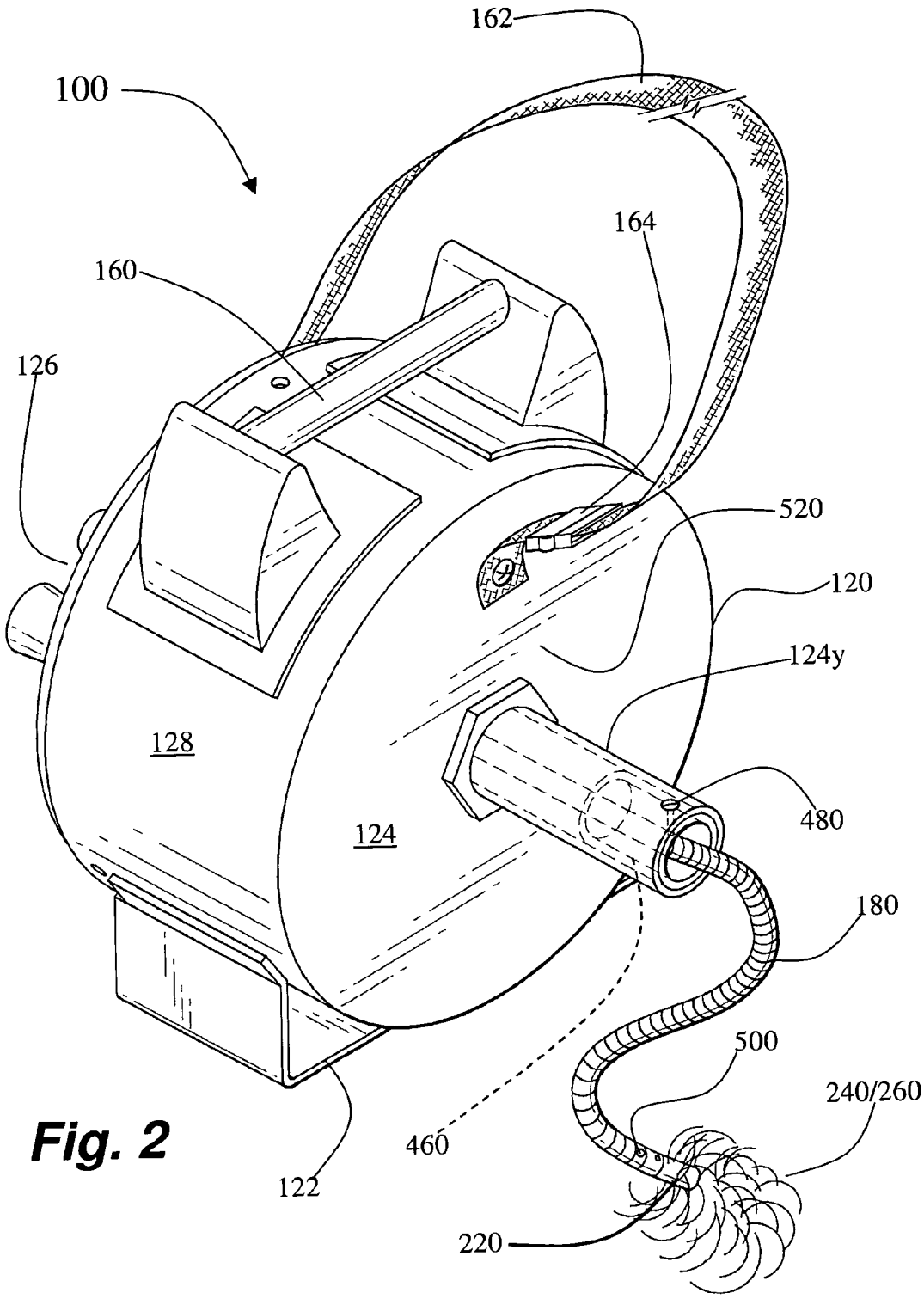
FIG. 2 shows a front perspective view of the cleaning device of FIG. 1.

Referring to the FIGURES in general, and FIG. 1 in particular. FIG. 1 is an environmental perspective view of the cleaning device 100 of the present invention. More specifically, the cleaning device 100 is shown placed atop a domestic laundry dryer LD for drying wet clothes. The cleaning device comprises a housing 120, a drive member 140, an optional carry handle 160, an optional shoulder-carrying strap 162, a cable 180 having a proximal end 200 (see, for example, FIG. 5) and a distal end 220, and a cleaning member 240 attached to the distal end 220 of cable 180. The driving member 140 is shown as a handle 140*h* in FIGS. 1 and 3, and as an electric drill 140*d* in FIG. 4. In one aspect of the invention, the drive member 140 is selected from the group consisting of a handle 140*h* and a drill 140*d*.

Figure 3:
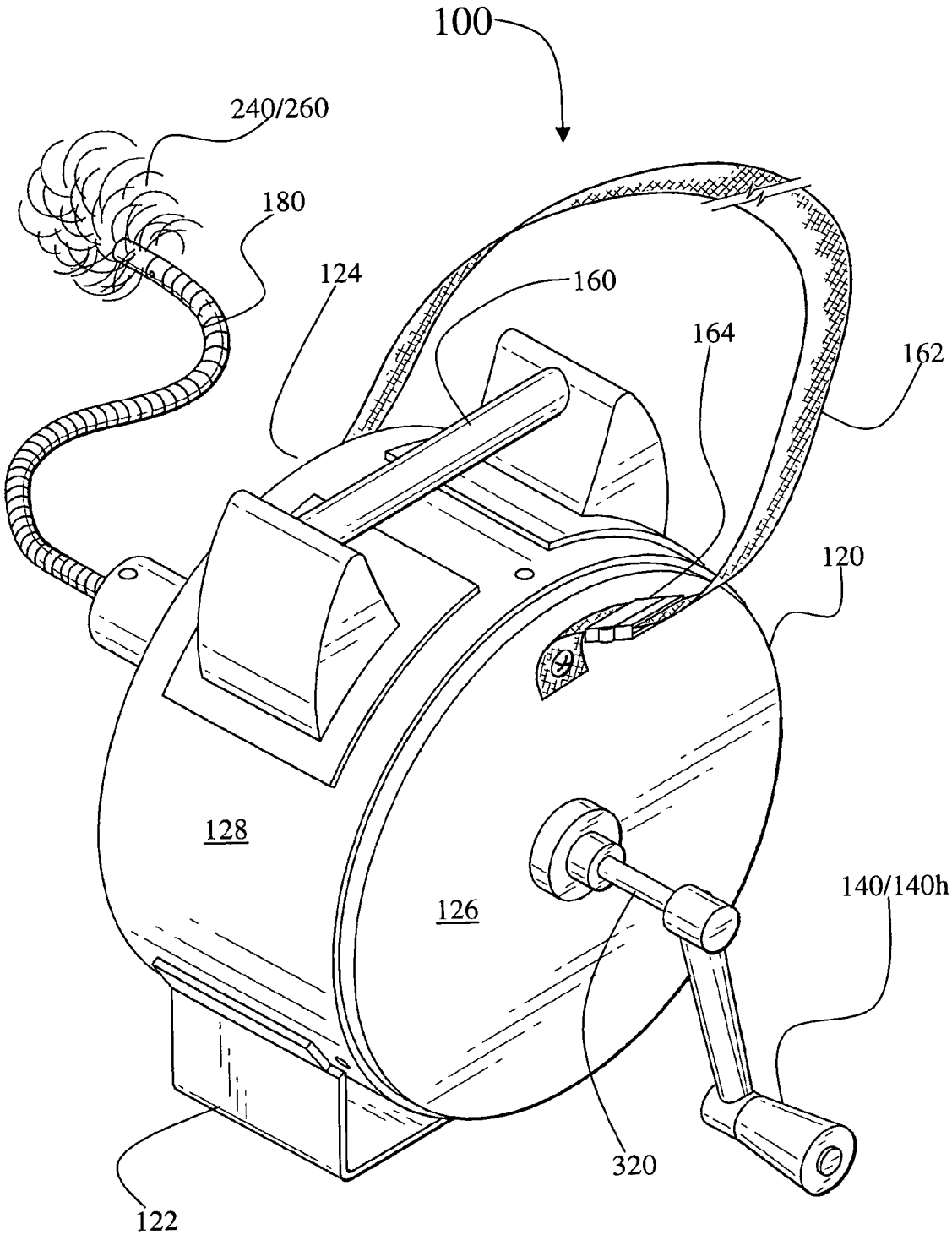
FIG. 3 shows a rear perspective view of the cleaning device of FIG. 1.
Figure 4:
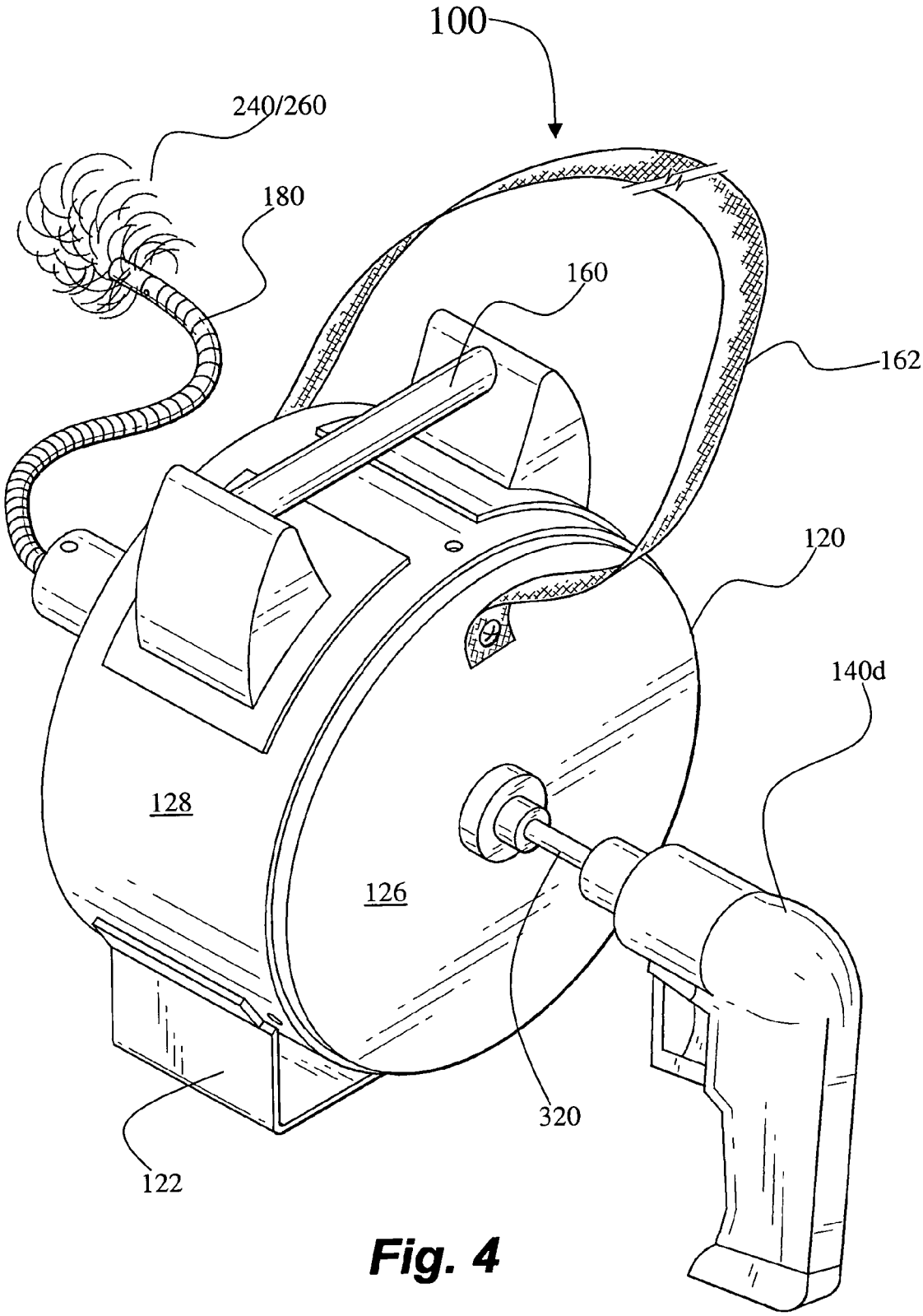
FIG. 4 shows a rear perspective view of the cleaning device of FIG. 1 with a power tool in place of a hand crank.

If used, the optional shoulder-carrying strap 162 can be attached to the housing 120 by any suitable means such as, but not limited to, a buckle system 164 (see FIG. 3). The buckle system 164 allows a user to attach or detach the strap 162 as desired. The operation of a buckle system is well known and is described in detail, for example, in U.S. Pat. No. 6,786,786 (issued to Davis). The content of U.S. Pat. No. 6,786,786 (Davis) is incorporated herein by reference in its entirety. The terms "human operator" and "user" are regarded herein as equivalent terms.

In FIG. 1, the cable 180 and cleaning member 240 are shown deployed inside a dryer's exhaust duct ED, which has been temporarily detached from the laundry dryer LD to permit a user (not shown) to manually feed the cable 180 (and cleaning member 240 attached to the distal end 220 of cable 180) into the dryer's exhaust duct ED. The cleaning member 240 can take several forms. For example, the cleaning member 240 can be a detachable brush 260 or a detachable dislodger 280 (see FIG. 5) for dislodging debris blocking, for example, a drainage or domestic sewer pipe. An optional housing stand 122 can be used to stabilize the housing 120.

Figure 5:
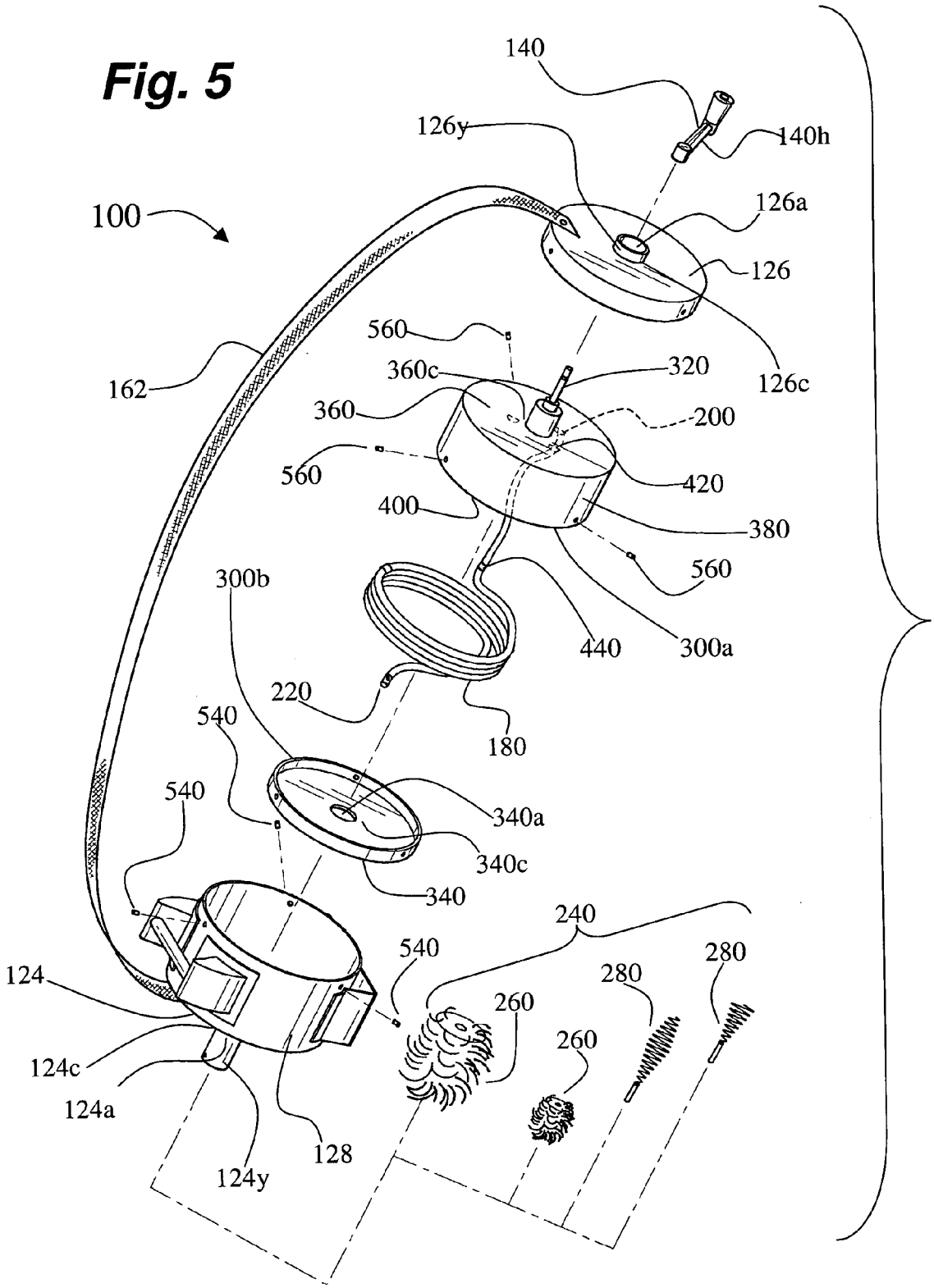
FIG. 5 shows an exploded perspective view of the cleaning device of FIG. 1.

The internal features of the cleaning device 100 can be discerned from an exploded view of the cleaning device 100 as shown in FIG. 5. The cleaning device 100 comprises a housing 120 of generally cylindrical appearance, an inner hollow drum 300 of generally cylindrical appearance, a drive member 140 for rotating the inner-drum 300, a drive shaft 320 connected to the inner-drum 300, a cable 180, and an at least one cleaning member 240 attachable to the distal end 220 of the cable 180. The inner-drum 300 is of generally cylindrical appearance and located inside housing 120.

Figure 6:
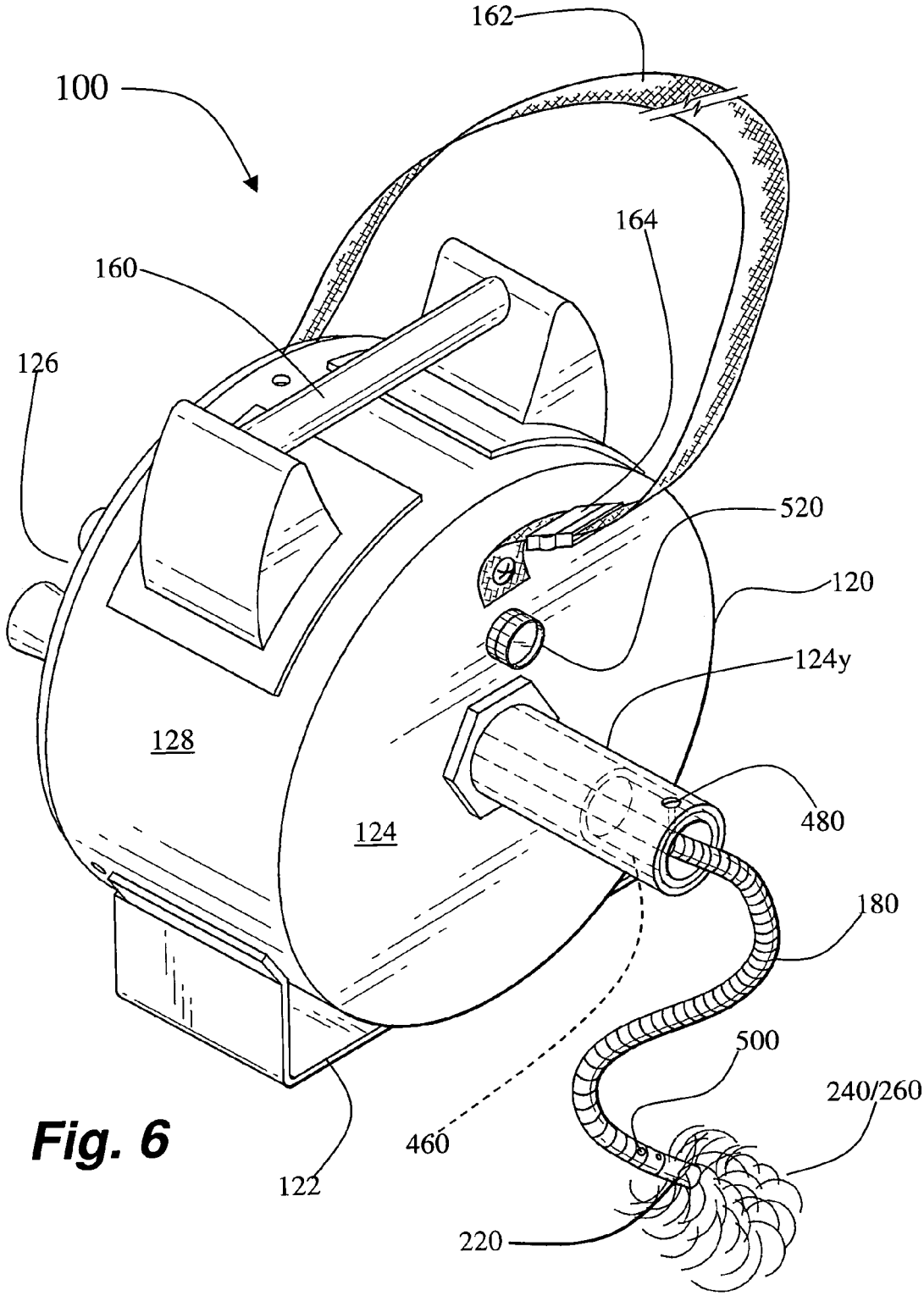
FIG. 6 shows a front perspective view of a cleaning device with a flashlight fitted to the cleaning device.

In more detail and with particular reference to FIGS. 5 and 6, the housing 100 has a front-end 124, a rear-end 126, and a cylindrical sidewall 128 disposed between front and rear ends 124 and 126. The cylindrical sidewall 128 and front-end 124 can form an integral unit as shown in FIG. 5. In an alternative embodiment, the cylindrical sidewall 128 and rear-end 126 form an integral unit. In a further alternative embodiment, the cylindrical sidewall 128, the front-end 124 and rear-end 126 can be in three separate pieces.

The front-end 124 of housing 100 has a center 124*c*. The center 124*c* defines an aperture 124*a*. A hollow bore cylinder 124*y* extends around and outward from the perimeter of aperture 124*a*. The rear-end 126 of housing 100 has a center 126*c*. The center 126*c* defines an aperture 126*a*. A hollow bore cylinder 126*y* extends around and outward from the perimeter of aperture 126*a*.

The inner-drum 300 has a drum front-end 340, a drum rear-end 360, a drum sidewall 380 disposed between front and rear ends 340 and 360. In FIG. 5, alphanumeric labels "300*a*" and "300*b*" represent the inner-drum 300. The drum sidewall 380 has an inner surface 400. The drum front-end 340 has a center 340*c*. The center 340*c* defines an aperture 340*a*. The drum rear-end 360 has a center 360*c*. Drive shaft 320 is coupled to, and extends outwards from, the center 360*c* of drum rear-end 360 as shown in FIG. 5. The drive shaft 320 can have any suitable cross-section such as a hexagonal cross-section. It will be understood by a person of ordinary skill in the art that the drive member 140 (such as, but not limited to, handle 140*h* or drill 140*d*) should comprise a complementary female end capable of receiving the male drive shaft 320.

The cable 180 is disposed at least partly inside inner-drum 300 and when wound up inside the inner-drum exerts pressure on the inner-surface 400. During typical use, at least part of the cable 180 is manually drawn out of the device 100 through hollow bore cylinder 124*y* (via aperture 340*a*) and pushed into a duct or pipe that requires cleaning and/or unblocking. The cable 180 remaining inside the drum sidewall 380 exerts pressure on the inner surface 400 of drum sidewall 380 such that when the drive shaft 320 is rotated, that part of the cable 180 located outside the device 100 also rotates even though there is no direct connection between the drive shaft 320 and cable 180. That part of the cable 180 located inside the inner-drum 300 acts somewhat like a spring coil exerting pressure on the inner-surface 400.

The diameter of the inner-drum 300 is selected to ensure that the cable 180 when wound is capable of exerting pressure against the inside of inner-surface 400. However, it should be understood that any suitable cable can be used such as, but not limited to, 0.25" hollow cable (Universal Product Code (UPC): 0-93122-10281-3), 0.25" wire rope center cable (Universal Product Code (UPC): 0-93122-10282-0) available from, for example, General PIPE CLEANERS (division of General Wire Spring Company), 1101 Thompson Avenue, McKees Rocks, Pa. 15136; FAX: 1-412-771-2771, TEL: 1-800-245-6200 or 1-412-771-6300). Examples of other cables are listed in TABLE 1.

TABLE 1

| CABLE | UPC |
|---|---|
| ¼" (6 mm) Diameter | 0-93122-61018-9 |
| | 0-93122-61020-2 |
| | 0-93122-61021-9 |
| ⅜" (10 mm) Diameter | 0-93122-61042-4 |
| | 0-93122-61043-1 |
| | 0-93122-61044-8 |
| ½" (13 mm) Diameter | 0-93122-61064-6 |
| | 0-93122-61066-0 |
| | 0-93122-61068-4 |

Referring to FIGS. 5 and 6, the proximal end 200 of cable 180 is optionally attached to the inside of inner-drum 300. For example, an at least one tie 420 can be used to attach the proximal end 200 to the inside of inner-drum 300. The at least one tie 420 can take the form of a loop, staple, tack, adhesive, or any other suitable attachment means. An optional cable retainer system can be used to keep the proximal end 200 inside the inner-drum 300. One or more retainer clips 440 can be attached to the cable 180 proximate to the proximal cable end 200. A retainer clip blocker, such as an inner cylinder 460 located in hollow bore cylinder 124*y*, is shown in FIG. 6. The inner cylinder has a hollow bore, which is sized such that its bore diameter is sufficient not to impede the movement of the cable 180 through cylinder 124*y*, while narrow enough to stop the retainer clip 440 from exiting out of cylinder 124*y*.

Still referring to FIGS. 5 and 6, a screw 480 or similar device can be used to keep the distal end 220 of cable 180 secured at least partly inside cylinder 124*y*, thereby preventing the cable 180 from being inadvertently wound out completely from inner-drum 300. A female screw receiver 500 can be used to affix the distal end 220 to the screw 480.

The cleaning member 240 (such as brush 260 or dislodger 280) is preferably detachable and interchangeable thereby allowing a user to choose the most suitable cleaning member 240 for a particular cleaning and/or blocking duct/pipe project.

An optional artificial light source 520 can be fitted to the front end 124 (see FIG. 6). The optional artificial light source 520 could be a simple on/off battery operated flashlight. The light source 520 would be useful for aiding an operator looking for a duct or pipe in sub-optimal light conditions, such as in a crawl space beneath a house or in an unlit room or attic, etc.

The cleaning device 100 of the present invention can be made out of any suitable material such as molded plastic. For example, the housing 100 and inner-drum 300 can be constructed from injected molded plastic components. The drive shaft 320 can be made from any suitable torque resistant plastic or metal alloy. Likewise with respect to, for example, the handle 140*h*. Any suitable tacking or attachment means can be used to assemble the components of the cleaning device 100. For example, screws or tacks 540 can be used to assemble the housing 100. Screws or tacks 560 can be used to assemble the inner-drum 300.

It should be understood that the anti-clockwise direction arrows shown in FIG. 1 (with respect to the handle 140*h* and cable 180) are not intended to be limiting on the invention. The handle 140*h* (and more generically, the drive member 140) can be turned in either direction, i.e., clockwise or anticlockwise, to indirectly rotate the cable 180 and cleaning member 240 at the distal end 220 of the cable 180.

In summary, the cleaning device 100 comprises: (1) a housing 120 of generally cylindrical appearance having a front end 124 and a rear end 126; (2) an inner-drum 300 having a front end 340, a rear end 360, a sidewall 380, and a sidewall inner-surface 400, wherein the inner-drum 300 is located inside the housing 120; (3) a drive shaft 320 protruding from the rear end 360 of the inner-drum 300 and through the rear end 126 of the housing 120; (4) a drive member 140 that is attachable to the drive shaft 320; (5) a cable 180 abutting against the inner-surface 400 of the inner-drum 300, wherein the cable 180 has opposite proximal 200 and distal 220 ends, wherein during normal operation the distal end 220 protrudes through the front end 340 of the inner-drum 300 and through the front end 124 of the housing 120; and (6) a cleaning member 240, wherein the cleaning member 240 is attachable to the distal end 220 of the cable 180, wherein rotation of the drive shaft 320 causes rotation of the inner-drum 300, and wherein rotation of the inner-drum 300 causes the distal end 220 of the cable 180 to rotate thereby rotating the cleaning member 240 when fitted to the distal end 220 of the cable 180. The cleaning device 100 can be supplied without, for example, the drive member 140 thereby leaving it to the buyer or user to decide what kind of drive member 140 they want to use.

As should now be evident, the cleaning device 100 of the invention helps reduce fire hazards with respect to, for example, electric clothes driers by keeping exhaust ducts clear of obstructions thereby allowing hot air to be removed safely and efficiently from the machine. The cleaning device 100 also helps reduce energy and maintenance costs. For example, the cleaning device 100 can be used to clean out drier exhaust ducts thereby allowing the electric drier to run more efficiently and in turn reduce clothes drying times.

The exemplary embodiments described above are meant to be illustrative, and not limiting of the scope of the invention.

I claim:

1. A cleaning device (100) for cleaning a generally elongated duct or pipe, comprising:

a housing (120) of generally cylindrical appearance having a front end (124) and a rear end (126);

an inner-drum (300) having a front end (340), a rear end (360), a sidewall (380), and a sidewall inner-surface (400), wherein said inner-drum (300) is located inside said housing (120);

a drive shaft (320) protruding from said rear end (360) of said inner-drum (300) and through said rear end (126) of said housing (120);

a cable (180) abutting against said inner-surface (400) of said inner-drum (300), wherein said cable (180) has opposite proximal (200) and distal (220) ends, wherein during normal operation said distal end (220) protrudes through said front end (340) of said inner-drum (300) and through said front end (124) of said housing (120); and a cleaning member (240), wherein said cleaning member (240) is attachable to said distal end (220) of said cable (180), wherein rotation of said drive shaft (320) causes rotation of said inner-drum (300), and wherein rotation of said inner-drum (300) causes said distal end (220) of said cable (180) to rotate thereby rotating said cleaning member (240) when fitted to said distal end (220) of said cable (180).

2. The cleaning device (100) according to claim 1, further comprising a shoulder-carrying strap (162).

3. The cleaning device (100) according to claim 1, further comprising a shoulder-carrying strap (162) in combination with a buckle system (164).

4. The cleaning device (100) according to claim 1, further comprising an artificial light source (520) fitted to said front end (124) of said housing (120).

5. The cleaning device (100) according to claim 1, further comprising a carry handle 160.

6. The cleaning device (100) according to claim 1, further comprising a housing stand (122) fitted to said housing (120).

7. The cleaning device (100) according to claim 1, wherein said cleaning member (240) is a detachable brush (260).

8. The cleaning device (100) according to claim 1, wherein said cleaning member (240) is a detachable dislodger (280).

9. The cleaning device (100) according to claim 1, further comprising a means for preventing said cable (180) from being inadvertently wound out completely from inner-drum (300).

10. A cleaning device (100) for cleaning a generally elongated duct or pipe, comprising:

a housing (120) of generally cylindrical appearance having a front end (124) and a rear end (126);

an inner-drum (300) having a front end (340), a rear end (360), a sidewall (380), and a sidewall inner-surface (400), wherein said inner-drum (300) is located inside said housing (120);

a drive shaft (320) protruding from said rear end (360) of said inner-drum (300) and through said rear end (126) of said housing (120);

a drive member (140) that is attachable to said drive shaft (320);

a cable (180) abutting against said inner-surface (400) of said inner-drum (300), wherein said cable (180) has opposite proximal (200) and distal (220) ends, wherein during normal operation said distal end (220) protrudes through said front end (340) of said inner-drum (300) and through said front end (124) of said housing (120); and a cleaning member (240), wherein said cleaning member (240) is attachable to said distal end (220) of said cable (180), wherein rotation of said drive shaft (320) causes rotation of said inner-drum (300), and wherein rotation of said inner-drum (300) causes said distal end (220) of said cable (180) to rotate thereby rotating said cleaning member (240) when fitted to said distal end (220) of said cable (180).

11. The cleaning device (100) according to claim 10, wherein said drive member (140) is selected from the group consisting of a handle (140*h*) and a drill (140*d*).

12. The cleaning device (100) according to claim 10, further comprising a shoulder-carrying strap (162).

13. The cleaning device (100) according to claim 10, further comprising a shoulder-carrying strap (162) in combination with a buckle system (164).

14. The cleaning device (100) according to claim 10, further comprising an artificial light source (520) fitted to said front end (124) of said housing (120).

15. The cleaning device (100) according to claim 10, further comprising a carry handle 160.

16. The cleaning device (100) according to claim 10, further comprising a housing stand (122) fitted to said housing (120).

17. The cleaning device (100) according to claim 10, wherein said cleaning member (240) is a detachable brush (260).

18. The cleaning device (100) according to claim 10, wherein said cleaning member (240) is a detachable dislodger (280).

* * * * *